US007883090B2

(12) United States Patent
Ito

(10) Patent No.: US 7,883,090 B2
(45) Date of Patent: Feb. 8, 2011

(54) BILL PROCESSING DEVICE

(75) Inventor: Osamu Ito, Himeji (JP)

(73) Assignee: Glory Ltd., Hyogo-Ken (JP)

( * ) Notice: Subject to any disclaimer, the term of this patent is extended or adjusted under 35 U.S.C. 154(b) by 530 days.

(21) Appl. No.: 11/891,969

(22) Filed: Aug. 14, 2007

(65) Prior Publication Data

US 2008/0042343 A1 Feb. 21, 2008

(30) Foreign Application Priority Data

Aug. 16, 2006 (JP) ..... 2006-221989

(51) Int. Cl.
*B65H 39/10* (2006.01)

(52) U.S. Cl. ..... 271/289; 271/3.01; 271/3.03; 271/290; 209/534

(58) Field of Classification Search ..... 209/534; 194/206, 207; 271/3.01, 3.03, 3.05, 3.06, 271/3.12, 3.13, 289, 288
See application file for complete search history.

(56) References Cited

U.S. PATENT DOCUMENTS 4,822,018 A * 4/1989 Hain ..... 271/3.2
4,905,840 A * 3/1990 Yuge et al. ..... 209/534
6,659,258 B2 * 12/2003 Otsuka ..... 194/206
7,357,303 B2 * 4/2008 Taniyama et al. ..... 235/379
2005/0023341 A1 * 2/2005 Taniyama et al. ..... 235/379

FOREIGN PATENT DOCUMENTS

JP 2005-165806 6/2005

OTHER PUBLICATIONS

European Patent Office Search Report (Date Jan. 28, 2009—6 pages).

* cited by examiner

*Primary Examiner*—Stefanos Karmis
*Assistant Examiner*—Jeremy Severson
(74) *Attorney, Agent, or Firm*—Renner, Kenner, Greive, Bobak, Taylor & Weber

(57) ABSTRACT

A bill processing device comprises a hopping part 101 for receiving a placed bill, a carrying part 202 for carrying a bill received by the hopping part 101, a plurality of stacking parts 104 for stacking a bill carried by the carrying part 202, a identifying part 201 for identifying a bill received from the hopping part 101, a placing and running out part 103 which accommodates a bill received from the hopping part 101 and which can send out the bill, and a controlling part 300 which controls the hopping part 101, the carrying part 202, the plurality of stacking parts 104, the identifying part 201 and the placing and running out part 103. The controlling part 300 controls them to determine a destination stacking part from the plurality of stacking parts 104 according to an identification result of the identifying part 201, and when a bill can not be stacked in the determined destination stacking part, the controlling part controls 300 them to carry a bill to the placing and running out part 103.

12 Claims, 7 Drawing Sheets

MEMORY 304

TRANSACTION INFORMATION 401

| TRANSACTION CODE | TOTAL AMOUNT |
|---|---|
| 001 | ¥123,000 |

ACCOMMODATION INFORMATION 402

| TRANSACTION CODE | DENOMINATION | DESTINATION STACKING PART |
|---|---|---|
| 001 | TEN-THOUSAND BILL | a |
| 001 | TWO-THOUSAND BILL | c |
| 001 | TEN-THOUSAND BILL | a |
| 001 | THOUSAND BILL | d |
| 001 | FIVE-THOUSAND BILL | b |

STACKING PART INFORMATION 403

| STACKING PART | STACKING CONDITION |
|---|---|
| a | FULL |
| b | 200 |
| c | 500 |
| d | 1000 |

FIG. 4

BILL PROCESSING DEVICE

BACKGROUND OF THE INVENTION

The present invention relates to a bill processing device which has a plurality of stacking parts and which sorts bills in which a plurality of denominations are mixed, and which carries the bills to predetermined stacking parts and counts a total amount of the bills, and more particularly, to a bill processing device capable of efficiently carries bills even when the bills can not be stacked on a destination stacking part.

In recent years, banking systems and the like use bill processing devices which check high volume bills whether they are real or counterfeit bills, which classify bills into respective denominations, count the bills and tie the bills in a bundle.

Such a bill processing device is for sorting bills of a plurality of denominations and carrying the bills to predetermined stacking parts. Therefore, it is possible to enhance the processing efficiency by increasing the number or capacity of stacking parts.

Japanese Patent Application Laid-open Publication No. 2005-165806 discloses such a bill processing device. According to the bill processing device described in Japanese Patent Application Laid-open Publication No. 2005-165806, bills placed on a hopper 11 are sequentially taken in, the bills are carried to stackers 121 to 123 of respective denominations, and when one stacker is filled with bills, the bill processing device is automatically stopped temporarily (step S23), an operator removes the filled stacker (S24), the operator pushes down "START/STOP" key 241 to restart the bill processing device (S25) (see paragraph 0026 and FIG. 6). The bills are counted (S1) after the bills are carried (S10).

If the number or capacity of the stacking parts is increased, however, the scale of the bill processing device is increased, and the producing cost and installation cost of the bill processing device are increased.

In the case of the bill processing device described in Japanese Patent Application Laid-open Publication No. 2005-165806, when one of the stackers is filled with bills, the bill processing device is temporarily stopped even if other stackers are not filled with bills. Thus, the processing efficiency is deteriorated correspondingly.

It is an object of the present invention to provide a bill processing device which is not stopped even if one or some of stackers are filled with bills without increasing the number or volume of stacking parts.

BRIEF SUMMARY OF THE INVENTION

According to the first aspect of the present invention, there is provided a bill processing device comprising a hopping part for receiving a placed bill, a carrying part for carrying a bill received by the hopping part, a plurality of stacking parts for stacking a bill carried by the carrying part, a identifying part for identifying a bill received from the hopping part, a placing and running out part which accommodates a bill received from the hopping part and which can send out the bill, and a controlling part which controls the hopping part, the carrying part, the plurality of stacking parts, the identifying part and the placing and running out part, wherein the controlling part controls them to determine a destination stacking part from the plurality of stacking parts according to an identification result of the identifying part, and when a bill can not be stacked in the determined destination stacking part, the controlling part controls them to carry a bill to the placing and running out part.

BRIEF DESCRIPTION OF THE SEVERAL VIEWS OF THE DRAWING

FIG. 4 illustrates a schematic diagram showing information stored in a memory 304;

DETAILED DESCRIPTION OF THE INVENTION

Embodiments of the present invention will be explained with reference to the drawings below. The embodiments are only examples and the invention is not limited to the embodiments.

Embodiment 1

Figure 1:
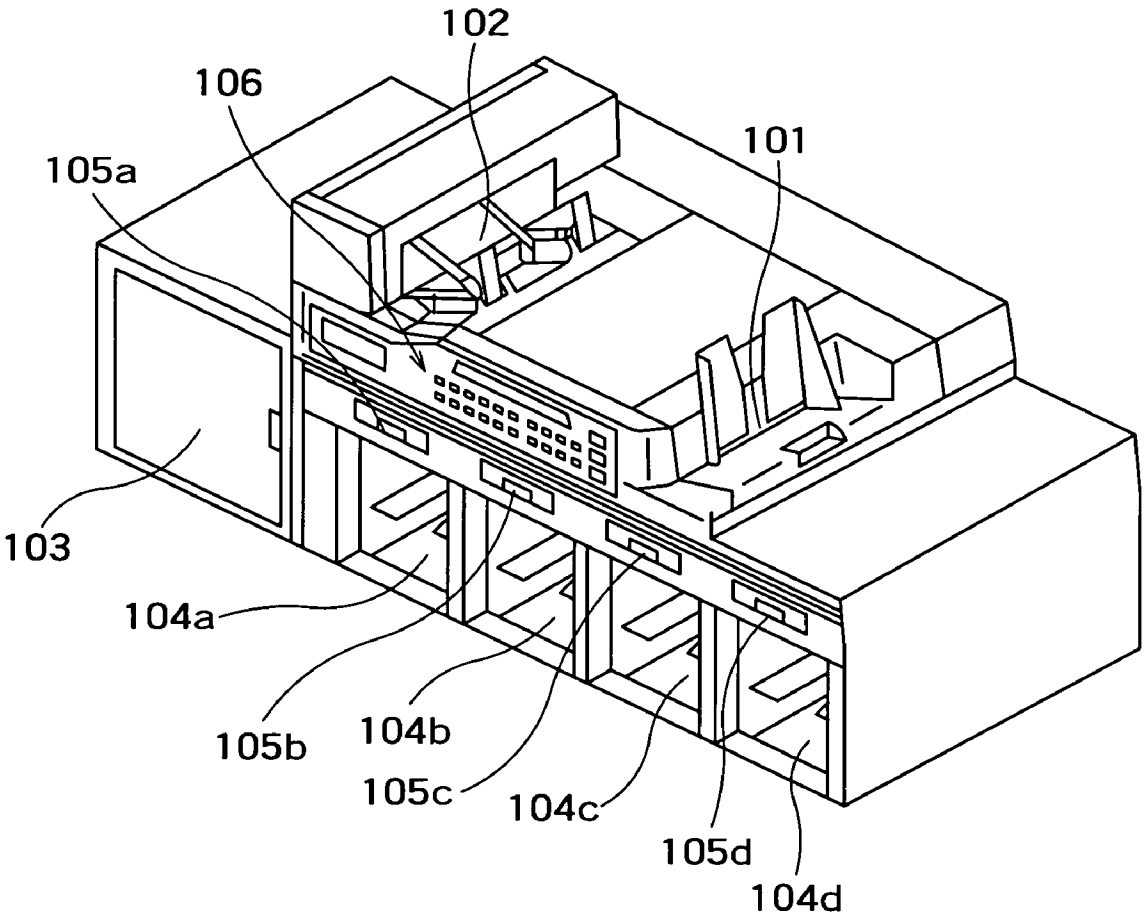
FIG. 1 illustrates a perspective view showing an external structure of a bill processing device according to one embodiment of the present invention.

FIG. 1 illustrates a perspective view showing an external structure of a bill processing device.

The bill processing device includes a hopping part 101, a rejecting part 102, a placing and running out part 103, stacking parts 104, alarming parts 105 and an operating and displaying part 106. The number of stacking parts 104 and the number of alarming parts 105 are two or more.

The hopping part 101 has a mechanism for receiving a bill placed by an operator into the device.

The rejecting part 102 has a mechanism for returning (rejecting) a bill received by the hopping part 101.

The placing and running out part 103 has a mechanism for accommodating a bill received by the hopping part 101 and a mechanism for sending the accommodating bill to the stacking part 104.

Each stacking part 104 has a mechanism for stacking a bill received by the hopping part 101.

The alarming parts 105 are provided in correspondence with the stacking parts 104, and each alarming part 105 has a mechanism for outputting a character, a sound or light.

The operating and displaying part 106 has a key for receiving instructions from an operator, and a display panel for displaying information to the operator.

Figure 2:
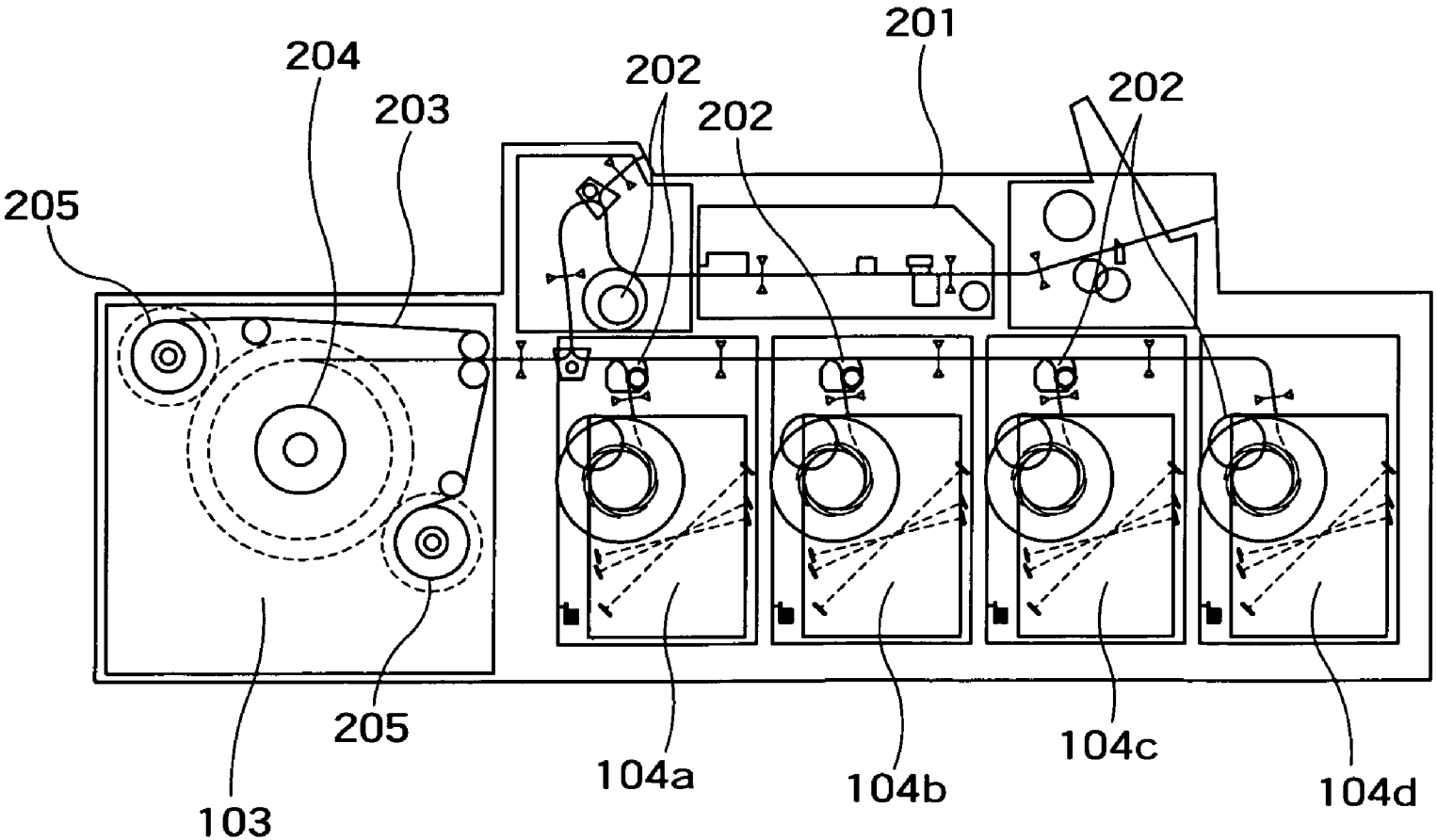
FIG. 2 illustrates a schematic diagram showing an internal structure of the bill processing device of one embodiment of the invention.

FIG. 2 illustrates a schematic diagram showing an internal structure of the bill processing device.

The bill processing device has a identifying part 201 and a carrying part 202.

The identifying part 201 has a mechanism for identifying "denominations" and "real bill or counterfeit bill" of bill received from the hopping part 101.

The carrying part 202 has a mechanism for carrying bills between the hopping part 101, the rejecting part 102, the placing and running out part 103 and the stacking part 104. The carrying part 202 also has a mechanism for counting the number of bills carried to each of the plurality of stacking parts 104.

The placing and running out part 103 has a belt 203, a rotary shaft 204 and two belt supplying parts 205.

The belt 203 is wound around the two belt supplying parts 205. The two belt supplying parts 205 rotate in a direction in which the belt 203 is supplied (clockwise direction in FIG. 2). With this, the belt 203 supplied from the two belt supplying parts 205 sandwiches bills carried by the carrying part 202 and sequentially accommodates the bills. The two belt supplying parts 205 rotate in a direction where the belt is wound (counterclockwise direction in FIG. 2), thereby sequentially sending out the accommodated bills. The order of the sent out bills is opposite from the accommodated bills.

Figure 3:
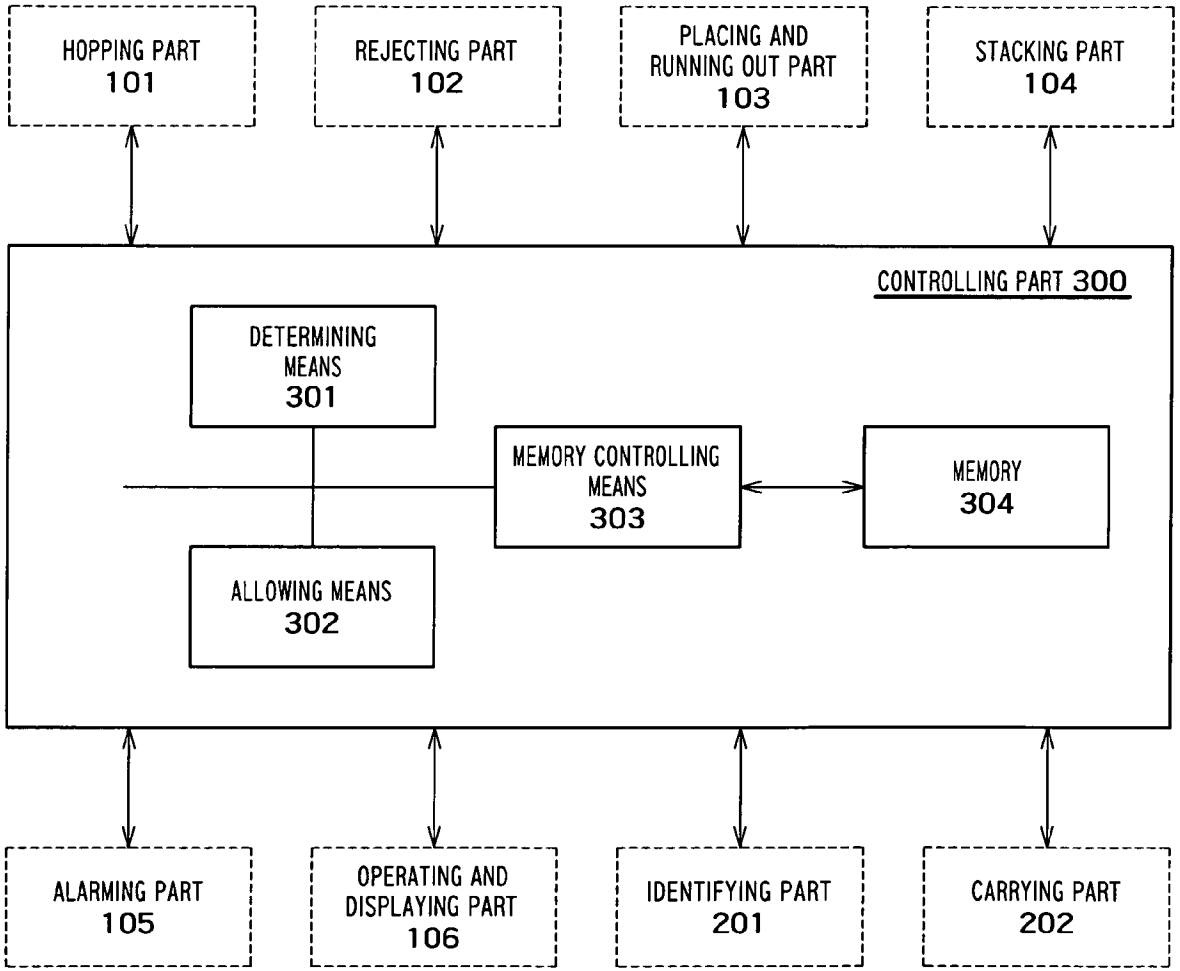
FIG. 3 illustrates a block diagram showing a function of a controlling part 300.

FIG. 3 illustrates a block diagram showing a function of the controlling part 300 which controls the hopping part 101, the placing and running out part 103, the stacking parts 104, the alarming parts 105, the operating and displaying part 106, the identifying part 201 and the carrying part 202.

The controlling part 300 gives operation instructions to the hopping part 101, the placing and running out part 103, the stacking parts 104, the alarming parts 105, the operating and displaying part 106, the identifying part 201 and the carrying part 202. The hopping part 101, the placing and running out part 103, the stacking parts 104, the alarming parts 105, the operating and displaying part 106, the identifying part 201 and the carrying part 202 are operated in accordance with the operation instructions from the controlling part 300.

The controlling part 300 includes a determining means 301, an allowing means 302, a memory controlling means 303 and a memory 304.

The determining means 301 determines a destination stacking part from the stacking parts 104 based on an identification result identified by the identifying part 201 or bill information stored in the memory 304.

The allowing means 302 determines whether bills can be stacked in the destination stacking part determined by the determining means 301.

The memory controlling means 303 reads and writes information from and into the memory 304.

Transaction information 401, accommodation information 402 and stacking part information 403 are stored in the memory 304.

FIG. 4 illustrates a schematic diagram showing information stored in the memory 304.

The transaction information 401 comprises transaction codes which uniquely correspond to respective transactions, and a total amount of each transaction code (a total amount of real bills received by the hopping part 101).

The accommodation information 402 comprises the transaction code, denominations of bills accommodated in the placing and running out part 103, and the destination stacking part of bills accommodated in the placing and running out part 103. The accommodation information sets 402 are stored in such an order that the accommodation information sets 402 are accommodated in the placing and running out part 103, and information sets of sent out bills are deleted. In the example shown in FIG. 4, bills are accommodated in the order of ten-thousand yen bills, two-thousand yen bills, one-thousand yen bills and five-thousand yen bills. The accommodated bills are sent out in inverse order. Therefore, five-thousand yen bills are sent out to the stacking part b first.

The stacking part information 403 comprises information for identifying the stacking parts, and stacking conditions of the stacking parts. In the example shown in FIG. 4, the stacking part a can not stack bills when the number of bills reaches FULL (maximum stacking number of stacking part), the stacking part b can not stack bills when the number of bills reaches 200 (preset number), the stacking part c can not stack bills when the number of bills reaches 500 (preset number), and the stacking part d can not stack bills when the number of bills reaches 1,000 (preset number).

Figure 5:
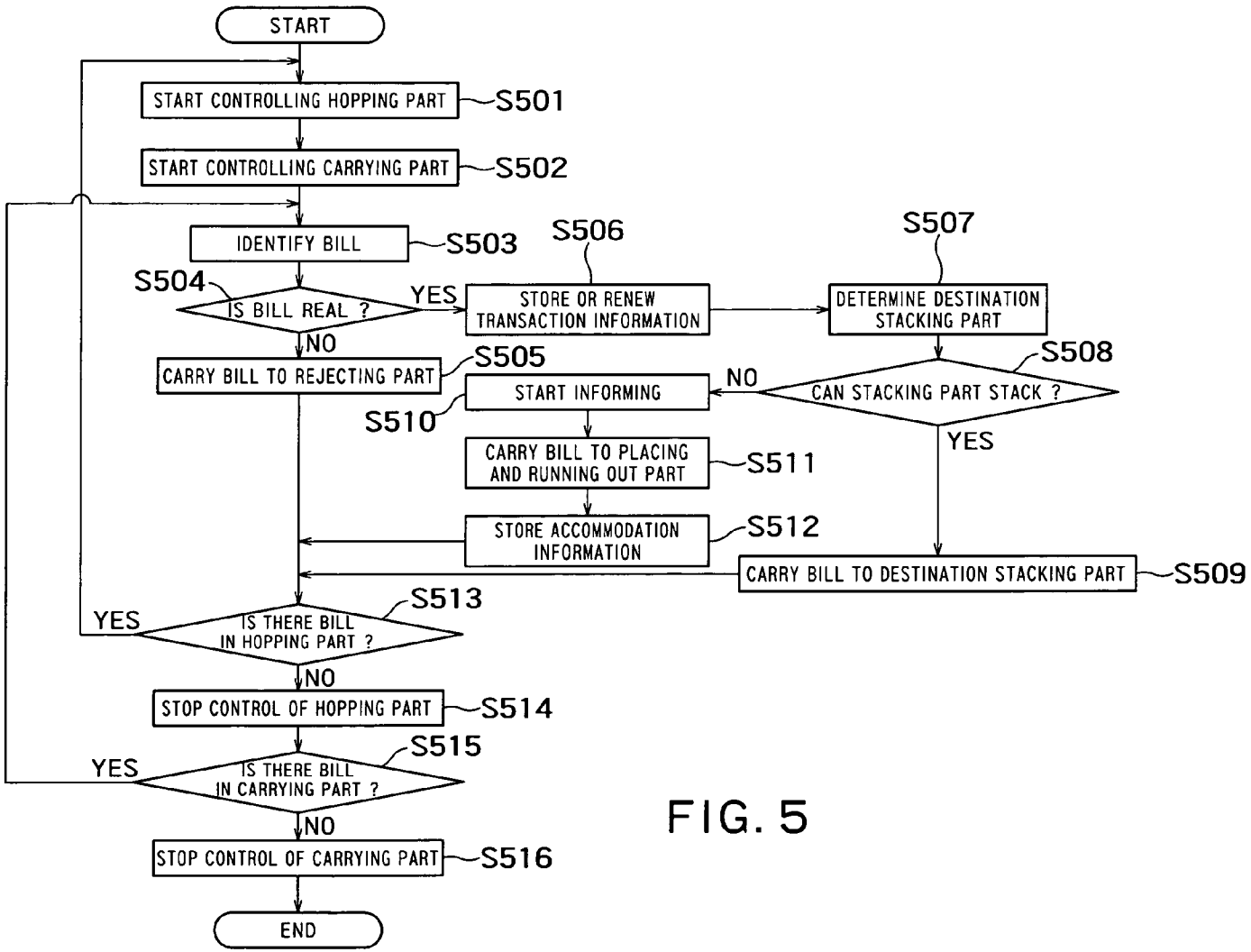
FIG. 5 illustrates a flowchart showing processing of a controlling part 300 of an embodiment 1 of the present invention.

FIG. 5 illustrates a flowchart showing processing of a controlling part 300 when bills placed on the hopping part 101 are stacked.

First, control of the hopping part 101 is started, and placed bills are received (S501).

Next, control of the carrying part 202 is started, and bills are carried to a predetermined destination (S502).

Then, the identifying part 201 is controlled to discriminate a denomination of the received bill and determine whether the bill is a real bill or a counterfeit bill (S503).

Then, it is determined whether the bill is a real bill based on the identification result of the identifying part 201 (S504).

The processing operations of S501 to S504 are continuously carried out without stopping control of the hopping part 101, the carrying part 202 and the identifying part 201.

When the bill is not a real bill (S504—No), the bill is carried to the rejecting part 102 (S505).

Then, it is determined whether there is a bill in the hopping part 101 (S513).

On the other hand, when the bill is a real bill (S504—Yes), the transaction information 401 is stored in the memory 304 (S506).

If another transaction information 401 having the same transaction code is stored in the memory 304, the transaction information is renewed. Then, a destination stacking part is determined according to an identification result of the identifying part 201 (S507).

Then, it is determined whether the destination stacking part can stack bills (S508). This determination is made by obtaining the number of bills stacked in each of the plurality of stacking parts 104 counted by the carrying part 202, and by checking the number against the stacking part information 403 stored in the memory 304. Even when a stacking part is brought into a state where the stacking part can not stack bills any more (bill-nonstackable state, hereinafter), if the stacked bills are tied in a bundle and removed from the stacking part, the bill-nonstackable state is released.

When it is possible to stack bills (S508—Yes), the bills are carried to the destination stacking part (S509).

Then, it is determined whether there is a bill in the hopping part 101 (S513).

On the other hand, when it is not possible to stack bills (S508—No), the alarming part 105 is controlled to inform an operator of the fact that there exists a stacking part which can not stack bills (S510).

Then, the carrying part 202 is controlled to carry bills to the placing and running out part 103 (S511).

Next, the accommodation information 402 is stored in the memory 304 (S512).

Then, it is determined whether there is a bill in the hopping part 101 (S513).

When there is a bill in the hopping part 101 (S513—Yes), the processing operations in S501 to S512 are repeated without stopping the hopping part 101.

On the other hand, when there is no bill in the hopping part 101 (S513—No), the control of the hopping part 101 is stopped (S514).

Then, it is determined whether there is a bill in the carrying part 202 (S515).

When there is a bill in the carrying part (S515—Yes), the processing operations in S503 to S512 are repeated without stopping the carrying part 202.

On the other hand, when there is no bill in the carrying part (S515—No), the carrying part 202 is stopped and the flow in FIG. 5 is completed.

Figure 6:
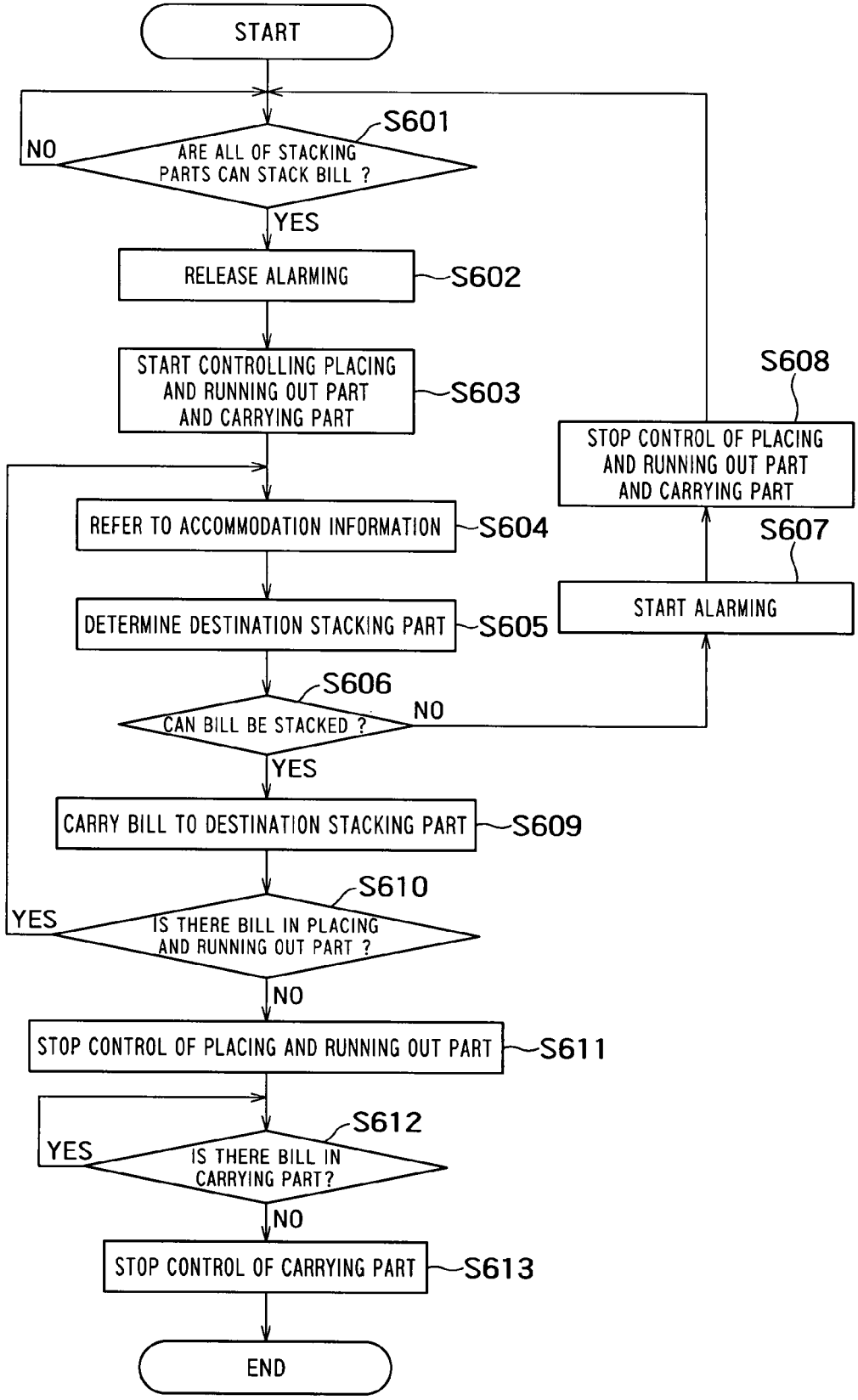
FIG. 6 illustrates a flowchart showing processing of the controlling part 300 when bills accommodated in a placing and running out part 103 are sent out.

FIG. 6 illustrates a flowchart showing processing of the controlling part 300 when a bill accommodated in the placing and running out part 103 is sent out.

First, it is determined whether all of the stacking parts 104 are in a state where the stacking part can stack bills (bill-stackable state, hereinafter) (S601). When there is at least one stacking part which is in the bill-nonstackable state (S601—No), the controlling part 300 controls them to wait until such a stacking part is brought into the bill-stackable state.

When all of the stacking parts are in the bill-stackable states (S601—Yes), the alarming part 105 is controlled to release the alarming operation (S602).

Then, control of the placing and running out part 103 and the carrying part 202 is started (S603). In this embodiment, bills are sent out in inverse order from the accommodating order (i.e., a bill which is accommodated last is sent out first).

Next, the accommodation information sets 402 stored in the memory 304 are referred to (S604). In this embodiment, the accommodation information sets 402 are referred to in inverse order from the storing order (i.e., a region of the memory 304 where the accommodation information sets 402 are stored functions as a FIFO memory).

Next, a destination stacking part is determined according to a destination stacking part included in the accommodation information 402 (S605).

Then, it is determined whether the destination stacking part can stack bills (S606). This determination is made in the same manner as that of in S508 shown in FIG. 5.

When the stack is in the bill-nonstackable state (S606—No), the alarming part 105 is controlled to again start the informing operation (S607).

Then, control of the placing and running out part 103 and the carrying part 202 is stopped (S608), and the procedure is return to S601.

On the other hand, when the stack is in the bill-stackable state (S606—Yes), the bill is carried to the destination stacking part (S609).

Then, it is determined whether there is a bill in the placing and running out part 103 (S610).

When there is a bill in the placing and running out part 103 (S610—Yes), the procedure is returned to S604.

On the other hand, when there is no bill in the placing and running out part 103 (S610—No), the control of the placing and running out part 103 is stopped (S611).

Then, it is determined whether there is a bill in the carrying part 202 (S612).

Then, the controlling part 300 controls them to wait until the carrying part 202 becomes empty (S612—No), the control of the carrying part 202 is stopped (S613), and the flow shown in FIG. 6 is completed.

According to the embodiment 1 of the present invention, when at least one of the stacking parts 104 is brought into the bill-nonstackable state, a bill which can not be stacked is accommodated in the placing and running out part 103.

Therefore, a bill placed on the hopping part 101 can be received in the bill processing device without stopping the operation of the bill processing device irrespective of the fact that the stacking part 104 is in the bill-stackable state or bill-nonstackable state, and the processing efficiency can be enhanced.

A bill which is to be carried to a stacking part 104 in the bill-stackable state of the plurality of stacking parts 104 is carried to the stacking part 104. Therefore, deterioration of the processing efficiency when one of a plurality of stacking parts 104 is brought into the bill-nonstackable state can be minimized.

When the accommodation information 402 is stored in the memory 304 and a bill is sent out from the placing and running out part 103, the accommodation information 402 is referred to. Therefore, it is unnecessary to again identify the bill (S503) and thus, the processing efficiency can be enhanced.

The transaction information 401 is stored or renewed before a bill is stacked in the stacking part 104. Therefore, it is possible to determine the transaction information 401 (total amount of transaction) before the bill is stacked in the stacking part 104.

Embodiment 2

In the embodiment 2, in addition to the embodiment 1, receiving processing of a bill in the hopping part 101 is carried out preferentially.

Figure 7:
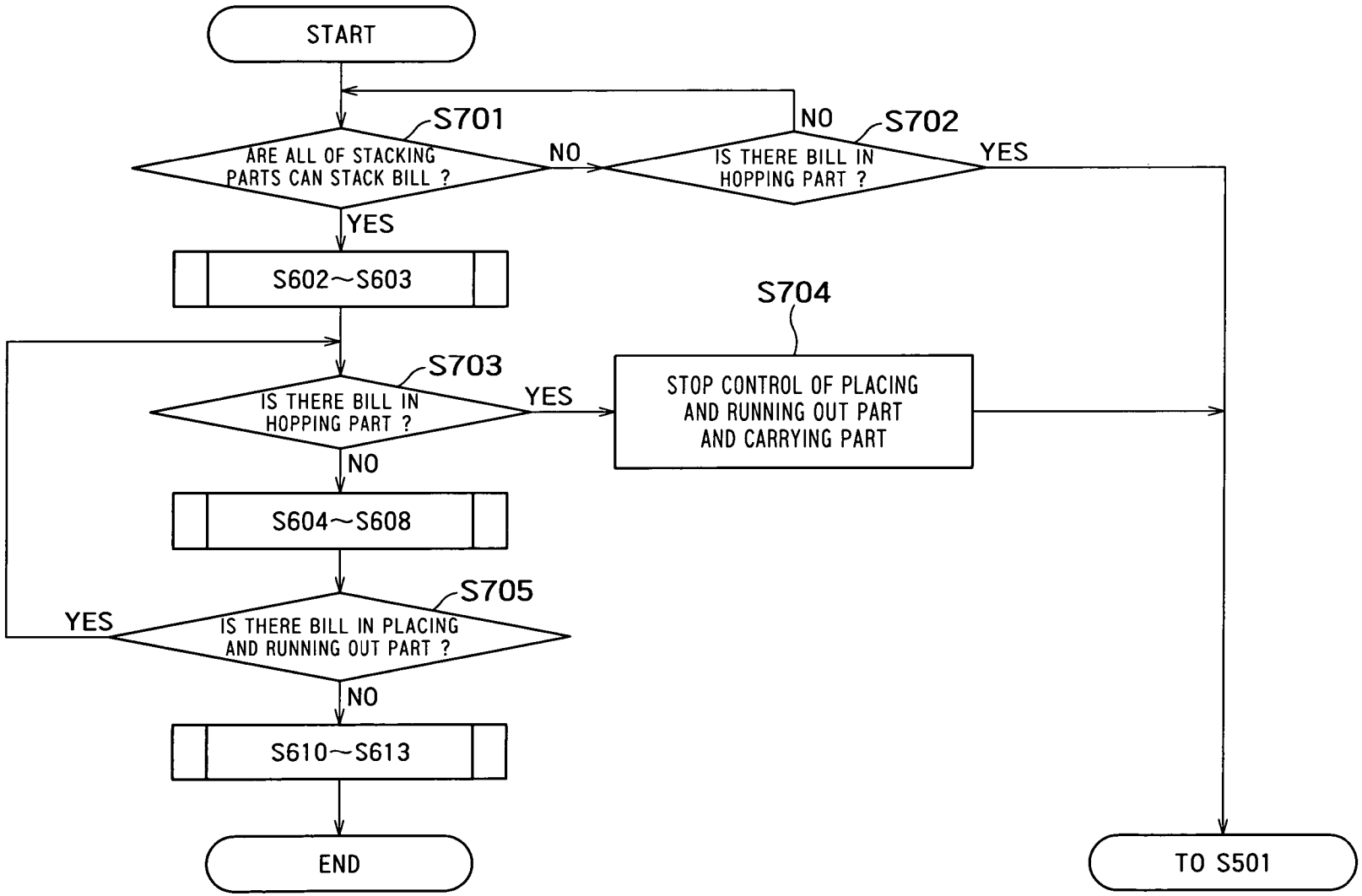
FIG. 7 illustrates a flowchart showing processing of a controlling part 300 according to an embodiment 2 of the present invention.

FIG. 7 illustrates a flowchart showing processing of a controlling part 300 according to the embodiment 2.

First, it is determined whether all of the stacking parts 104 are in the bill-stackable state (S701).

When at leas one of the stacking parts 104 is in the bill-nonstackable state (S701—No), it is determined whether there is a bill in the hopping part 101 (S702).

Then, when there is a bill in the hopping part 101 (S702—Yes), the procedure is shifted to S501 shown in FIG. 5.

On the other hand, when there is no bill in the hopping part 101 (S702—No), the procedure is returned to S701.

When all of the stacking parts 104 are in the bill-stackable state (S701—Yes), the processing operations which are the same as those in S602 to S603 are carried out. Then, it is determined whether there is a bill in the hopping part 101 (S703).

When there is a bill in the hopping part 101 (S703—Yes), control of the placing and running out part 103 and the carrying part 202 is stopped (S704), and the procedure is shifted to S501 shown in FIG. 5.

On the other hand, when there is no bill in the hopping part 101 (S703—No), the processing operations in S604 to S608 shown in FIG. 6 are carried out. Then, it is determined whether there is a bill in the placing and running out part 103 (S705).

When there is a bill in the placing and running out part 103 (S705—Yes), the procedure is returned to S703. When there is no bill in the placing and running out part 103 (S705—No), the processing operations in S610 to S613 shown in FIG. 6 are carried out, and the flow shown in FIG. 7 is completed.

According to the embodiment 2, it is possible to further enhance the processing efficiency by preferentially receiving a bill from the hopping part 101.

What is claimed is:

1. A bill processing device comprising:

a hopping part for receiving a placed bill, a carrying part for carrying a bill received by the hopping part, a plurality of stacking parts for stacking a bill carried by the carrying part, an identifying part for identifying a bill received from the hopping part, a placing and running out part which accommodates a bill received from the hopping part and which is configured to send out the bill into the carrying part, and a controlling part which controls the hopping part, the carrying part, the plurality of stacking parts, the identifying part and the placing and running out part, wherein the controlling part controls them to carry a bill into a destination stacking part determined from the plurality of stacking parts according to an identification result of the identifying part, when the destination stacking part is ready to receive the bill to be stacked therein, the controlling part controls them to carry a bill into the placing and running out part when the destination stacking part is not ready to receive the bill to be stacked therein, and the controlling part controls them to carry the bill that has been accommodated in the placing and running out part to the destination stacking part when the destination stacking part is made ready to receive the bill again.

2. The bill processing device according to claim 1, wherein the placing and running out part includes a belt, a rotary shaft connected to one end of the belt and a plurality of belt supplying parts for supplying the belt, if the belt supplying parts rotate in a direction in which the belt is supplied, the bill is sandwiched, and if the belt supplying parts rotate in a direction in which the belt is reeled up by the belt supplying parts, the bill is sent out into the carrying part.

3. The bill processing device according to claim 1, further comprising a memory capable of storing accommodation information concerning a bill accommodated in the placing and running out part, wherein when a bill is carried to the placing and running out part, the controlling part controls them to store the accommodation information in the memory, and when a bill is sent out from the placing and running out part, the controlling part controls them to determine the destination stacking part from the plurality of stacking parts based on the accommodation information stored in the memory.

4. The bill processing device according to claim 3, wherein the controlling part controls them to store transaction information in the memory according to an identification result of the identifying part, and to determine a total amount of bills received by the hopping part according to the transaction information.

5. The bill processing device according to claim 1, wherein the controlling part determines that the destination stacking part is ready to receive the bill when the number of bills stacked in the destination stacking part is less than a predetermined number.

6. The bill processing device according to claim 5, wherein the predetermined number is the number of bills which can be stacked in the stacking part.

7. The bill processing device according to claim 1, further comprising an alarming part which informs an operator of a fact that the destination stacking part can not stack a bill, wherein when the destination stacking part can not stack a bill, the controlling part controls the alarming part to inform the operator the fact.

8. The bill processing device according to claim 7, wherein the alarming part informs an operator using a character, a sound or light.

9. The bill processing device according to claim 7, wherein when a bill is placed on the hopping part after the controlling part controls the alarming part, the controlling part controls the hopping part to receive the placed bill.

10. The bill processing device according to claim 7, wherein when the destination stacking part is brought into a state where the destination stacking part can stack a bill after the controlling part controls the alarming part, the controlling part controls them so that a bill sent out by the placing and running out part is carried to the destination stacking part.

11. The bill processing device according to claim 1, wherein when there are bills in the hopping part and the placing and running out part, the controlling part preferentially controls the hopping part to receive the placed bill.

12. The bill processing device according to claim 11, wherein when the controlling part controls the placing and running out part, the controlling part controls them to determine whether a bill exists in the hopping part.

* * * * *